US005779403A

United States Patent [19]

Kleine et al.

[11] Patent Number: 5,779,403

[45] Date of Patent: Jul. 14, 1998

[54] PERCUSSIVE BLOW ASSISTED ROTARY DRILL

[75] Inventors: Werner Kleine, Achim; Axel Neukirchen, Drensteinfurt; Werner Bongers, Iffeldorf, all of Germany

[73] Assignee: Hilti Aktiengesellschaft, Schaan, Liechtenstein

[21] Appl. No.: 762,181

[22] Filed: Dec. 9, 1996

[30] Foreign Application Priority Data

Dec. 7, 1995 [DE] Germany ..... 195 45 647.5

[51] Int. Cl.[6] ..... B23B 51/00

[52] U.S. Cl. ..... 408/230; 408/227; 408/224; 408/225; 175/389; 175/395; 175/415

[58] Field of Search ..... 408/230, 227, 408/231, 224, 225, 223, 226; 175/389, 395, 415, 420.1

[56] References Cited

U.S. PATENT DOCUMENTS

| | | | |
|---|---|---|---|
| 748,890 | 1/1904 | Taylor et al. | 408/224 |
| 3,966,349 | 6/1976 | Osman et al. | 408/227 |
| 4,293,252 | 10/1981 | Kress et al. | 408/224 |
| 4,549,616 | 10/1985 | Rumpp et al. | 408/226 |
| 4,596,498 | 6/1986 | Kress | 408/226 |
| 5,154,550 | 10/1992 | Isobe et al. | 408/231 |
| 5,443,337 | 8/1995 | Katayama | 408/230 |

FOREIGN PATENT DOCUMENTS

| | | | |
|---|---|---|---|
| 118806 | 9/1984 | Germany | 408/231 |
| 54-39290 | 3/1979 | Japan | 408/224 |
| 60-67012 | 4/1985 | Japan | 408/224 |

*Primary Examiner*—Daniel W. Howell
*Assistant Examiner*—Adesh Bhargava
*Attorney, Agent, or Firm*—Anderson, Kill & Olick, P.C.

[57] ABSTRACT

A percussive blow assisted rotary drill includes an axially extending shank (1) with a leading end face (3) and an axially extending outside surface (2) containing a helically extending drilled material removal groove (4, 5). At least one hard metal cutting plate (6) extends across a diameter of the shank and has a base part fixed in a continuous groove (9) in the leading end face (3) of the shank (1). The base part (10) is reinforced by an outwardly extending projection (12) in at least one of its side surfaces extending across the shank diameter. Preferably, the projections forms a part of a circle and are centered between the opposite ends of the cutting plate. The continuous groove (9) has a recess in at least one of its side surfaces shaped to coincide with the shape of the outward projection (12) on the cutting plate. Accordingly, the base part (10) is secured in a positively locked manner and preferably is centered in the leading end face of the shank.

16 Claims, 2 Drawing Sheets

PERCUSSIVE BLOW ASSISTED ROTARY DRILL

BACKGROUND OF THE INVENTION

The present invention is directed to a percussive blow assisted rotary drill having an axially extending shank with a leading end face and at least one main drilled material removal groove extending helically from the leading end face in an axially extending outside surface of the shank. A unitary cutting plate is fitted into a groove extending across the leading end face of the shank. The cutting plate has the base portion fixed in a continuous groove in the leading end face of the shank and extending across the diameter of the shank.

Percussive blow assisted rotary drills are drill bits used with axially percussive blow assisted rotary drilling tools. In particular, the drilling tools are rock or masonry drilling tools used for percussive blow assisted rotary drilling of bores and the like in concrete or masonry. A percussive blow assisted rotary drill of the general type is known, for example, from EPA-A-0 322 565. The drill has an axially extending shank with at least one drilled material removal groove in its outside surface extending helically from the leading or cutting end of the shank toward its chuck end. A continuous groove is formed in the leading end of the shank and extends across its diameter. A cutting plate with at least one carbide alloy cutting edge has its base part inserted and fixed in the groove. The cutting plate is soldered into the leading of the shank. The cutting plate is beveled in a roof-shaped manner with a centrally arranged tip and with cutting edges sloping rearwardly and outwardly from the tip for removing material during the drilling operation. Two mechanisms participate in the removal of the drilled material. The leading central tip of the percussive blow assisted rotary drill is hammered into the receiving material by axial blows similar to that applied to a chisel. The rotary motion of the drill causes a spalling or shearing of the receiving material. The drilled material is conveyed out of the borehole being formed by at least one main removal groove in the shank. Due to the cutting edge geometry, particularly high loads are developed at the central tip during drilling operation. Especially during spot drilling, when the peripheral regions of the cutting plate are not yet in engagement with the receiving material, the entire energy of the axial blows is directed to the central tip.

Accordingly, the central tip is worn down prematurely in known percussive blow assisted rotary drills. The drill becomes blunt causing unfavorable spot drilling and centering, and, in addition, the drilling output is reduced often after a short period of time. In a most unfavorable case, the excessively high loading of the central tip of the cutting plate, especially during spot drilling, can cause fracture in the shank end bordering the cutting plate or of the cutting plate itself which is formed of carbide alloy. Another disadvantage of such known drills involves the comparatively large effort required to position the cutting plate accurately in the continuous groove in the leading end of the shank. It must be accurately centered with its overhang or outward projection at the opposite sides of the outside surface of the shank being exactly equal to assure a uniform centered rotation and to prevent jamming of the drill in the borehole being formed.

SUMMARY OF THE INVENTION

Therefore, the primary object of the present invention is to provide an percussive blow assisted rotary drill which, in particular, is largely unaffected by high loading due to the axial blows produced during spot drilling. Failure of the cutting plate is avoided. The insertion and centering of the cutting plate in a continuous groove in a leading end of face of the drill shank is facilitated. The inserted cutting plate has the same radially extending end projection from the opposite ends of the groove extending outwardly from the outside surface of the shank, whereby a uniform centered rotation of the drill is assured in actual operation. The drilling tool can be fabricated so that modifications of its cutting geometry for improving the drilled material removal volume and the useful life of the drill can be effected in a simple manner.

The solution of these improvements is provided in the formation of the cutting plate. The base portion of the cutting plate, inserted in the groove in the leading end of the shank, is strengthened or reinforced in the region of the groove spaced from its ends, preferably in the central region of the cutting plate where its outward projection is part of a circular shape. The continuous groove in the leading end of the shank has a corresponding recess for receiving the outward projection of the cutting plate. This arrangement centers the base portion of the cutting plate and the shank affording a positive lock. By strengthening the base portion of the cutting plate, preferably in the central area, the base portion is positioned precisely in the center region of the drill which is particularly highly loaded by axial blows and is reinforced. Even if reinforcing steel is struck during the drilling operation, the danger of failure of the drill in the region bordering a cutting plate or of the cutting plate itself, is effectively reduced by the reinforcement of the central region. In particular, during spot drilling of the receiving material, it is possible for the reinforced cutting plate to better absorb the energy of the axial blows. As a result, the drill is not dulled prematurely and has an improved useful life. The cutting plate is centered in a positively locked manner by the projection in the central region of its base portion and the projection is basically partly circularly shaped and seated in the recess located in the central region of the continuous groove which extends across the diameter of the shank. Such an arrangement clearly facilitates the insertion of the cutting plate into the continuous groove. Since the central region of the cutting plate is fixed in the groove by a positive lock, it is assured that the cutting plate has the same projection outwardly from the outside surface of the shank at both of the opposite ends of the groove. Accordingly, the drill can be centered in a simple manner. The recess in the groove corresponding to the shape of the projection from the base portion of the cutting plate can be cut in a simple work step, for instance, following the formation of the continuous groove. The positively locked centering of the inserted cutting plate, however, also facilitates the subsequent attachment of the plate by soldering with the subsequent curing or hardening.

In a preferred embodiment, the central region of the base portion of the cutting plate has two symmetrically arranged partly circularly shaped projections with the projections held in a positively locked manner by two correspondingly shaped recesses provided in opposite surfaces of the groove. The symmetrical disposition of the recesses facilitates their fabrication. Due to the symmetrical design of the base portion of the cutting plate, the plate can be inserted into the recesses in the groove in positions turned through 180° further facilitating the overall fabrication of the percussive blow assisted rotary drill.

In one embodiment of the invention, the reinforcement afforded by the projection from the base portion of the cutting plate is essentially cylindrical in the axial direction of the shank. Accordingly, the central recess in the groove can be manufactured by a simple cylindrical drilling operation and can be formed prior to, simultaneously with, or directly after forming the groove in the leading end base of the shank.

In another embodiment of the invention, the outward projection on the plate can be shaped in the axial direction of the shank in an conical manner where the apex of the cone is located rearwardly of and opposite the hard alloy tip and is embedded into the leading end regions of the shank. The conically shaped bore in the shank can be fabricated similar to a countersink, however, it can be formed by a deformation process, that is, in an embossing manner.

In a preferred embodiment of the invention, the maximum cross section of the outward projection is approximately 1.2 times to twice the thickness of the cutting plate which is formed of carbide alloy and preferably has a thickness of 1.5 times that of the cutting plate. Accordingly, it is assured that the cutting plate is held on all sides by a sufficiently thick material layer of the shank in the region of the reinforcing projection which is circularly shaped in cross-section, so that the region of the shank bordering the cutting plate does not experience any failure.

In another variation of the invention, the cutting plate is separated into several connected parts comprising a central cutting edge part and two outwardly located parts each on an opposite side of the central part with the parts connected together by thin connecting webs. The thickness of the connecting webs is less than the thickness of the central part or of the outwardly located parts. The central cutting edge extends axially outwardly from the reinforcing projections on the base portion of the cutting plate and also projects axially outwardly beyond the outwardly located parts. The outwardly located parts are spaced outwardly from the central cutting edge and such spacing is greater than the length of the connector webs and preferably greater than the thickness of the cutting plate but smaller than half of the enveloping circle diameter of the central cutting edge. Such an embodiment of the drill is particularly advantageous in large diameter drills. By dividing the cutting plate, the carbide alloy cutting edge is separated into a central cutting edge with the reinforcement provided by the radially outwardly extending projections and into two outwardly extending parts each on an opposite side of the central part. The outwardly located parts can be used in cutting. It has been found, however, that it is unnecessary to machine the entire diameter of the borehole being formed in a chip removing manner. It is sufficient if the cutting and comminution of the receiving material occurs in concentric regions, similar to a break down drill. The regions of the borehole remaining standing have only a low stability, because of the brittle fracture properties of the receiving material and they breakup due to the percussive shocks afforded by the axial blows of the drill. By working on the receiving material in concentrically running regions, the reaction forces developed for the formation of a borehole having a large diameter are reduced. The percussive blow assisted rotary drill formed in accordance with the present invention, especially those having a large diameter, can also be used with satisfactory results by drilling tools with only average or low output, since the required material removing energy is reduced. With a given available material removal energy, a percussive rotary drill formed in accordance with the present invention, increases the material removing speed compared to a conventional drill.

The division of the cutting plate formed of a hard metal or carbide alloy into separate parts connected by thin webs has the advantage that expensive and relatively difficult to process hard metals or carbide alloy can be saved in the production of the percussive blow assisted rotary drill. A unitary cutting plate is still available for assembly and can be inserted as a single piece in a positively locked manner into the continuous groove in the leading end face of the shank. Another advantageous feature of the thin webs connecting the central cutting part with the outwardly located parts is that they serve as rated break points in the event of excessive shear stresses particularly in the outwardly located parts. The cutting plate does not fracture in an uncontrolled manner in the region of the parts formed as cutting edges, rather, it fractures in a targeted manner only at the connecting webs of the parts, which after the cutting plate is fixed in the groove in the leading end of the shank does not have any load bearing or retaining function. Even with fractured webs, the percussive blow assisted rotary drill formed in accordance with the invention remains completely functional.

It is advantageous for dimensioning the reinforcing projections in a multi-part cutting plate, if the longitudinal extent of the cutting edge is at least equal to or preferably larger than the maximum cross sectional diameter of the circularly shaped projection.

In yet another embodiment of the invention, the leading end of the shank supporting the carbide alloy cutting edges is equipped with guide elements fixed in the leading end face or in the outside surface of the shank so that they project beyond the surface of the shank. The outward projection of such guide elements is equal to or less than the projection of the opposite ends of the cutting plate. Because of the slight outward projection, the guide elements contribute almost nothing to the comminution of the receiving material being drilled and, to all intents and purposes, are not loaded or stressed by the axial blows applied to the drill. To improve the guidance and the concentric rotation properties of the drill of the present invention, the shape of the guide elements extending circumferentially is matched to the shape of the outside surface of the shank. For instance, the axially extending surfaces forming a boundary of the guide elements is a cylindrical surface with a radius of curvature adapted to the radius of curvature of the outside surface of the shank.

In an interesting variation of the percussive blow assisted rotary drill embodying the invention, the outwardly located parts connected to the central part by connecting webs are set back axially and radially relative to the additional cutting edges projecting beyond the outside surface of the shank and embedded in the leading end face of the shank. In this way, the outwardly located parts serve as guide elements, while the cutting or chip removal in the radially outer regions of the borehole are performed by the additional cutting edges. In this embodiment, at least one main drilled material removal groove is associated with the additional cutting edges. The advantage gained in such an embodiment is that the main loading of the cutting plate is involved more in the transmittal of axial blows and permits such loading to be optimized without concern for the outwardly located parts of the cutting plate. The unitary cutting plate can thus be fabricated in a very rugged manner while the additional cutting edges can be optimized in a known manner independently of their cutting task with regard to their thickness, the cutting edges and the angles thereof. It is advantageous for space reasons regarding the drilled material removal grooves, if the guide elements or additional cutting edges at the shank end are arranged at an acute angle relative to the continuous groove for the cutting plate. The additional cutting edges can be located on a diameter of the shank, however, they can be arranged completely asymmetrical. This increases the free space between a guide element or an additional cutting edge on the outwardly located part of the cutting plate leading in the circumferential or rotational direction, and this increased space can be used for dimensioning the main removal groove to be larger for the removal of the drilled material. The remaining region between the guide element or the additional cutting edge on the outwardly located part on the cutting plate lagging in the rotational direction can be used for an additional drilled material removal groove.

In a particularly advantageous embodiment of the invention, the cutting plate is formed of an impact resistant material and the additional cutting edges are formed of a harder material than the cutting plate. Accordingly, the reinforced centrally arranged cutting edge and the additional cutting edges can be selected precisely according to the loads to be experienced and can be formed of hard metal or carbide alloy materials particularly suited for the specific use. The simple installation of the cutting plate and the additional cutting edges is retained in such an embodiment. The shank need only be provided with a continuous groove having at least one partly circular shaped recess in its central region. The cut for the auxiliary cutting edges can be formed in the same working step.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
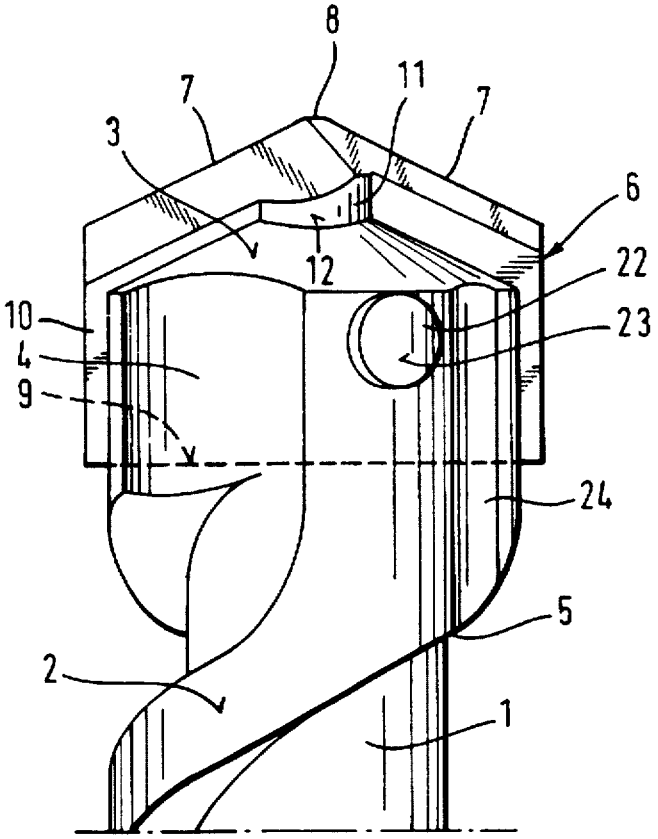
FIG. 1 is a side view of a leading end region of a percussive blow assisted rotary drill embodying the present invention.
Figure 2:
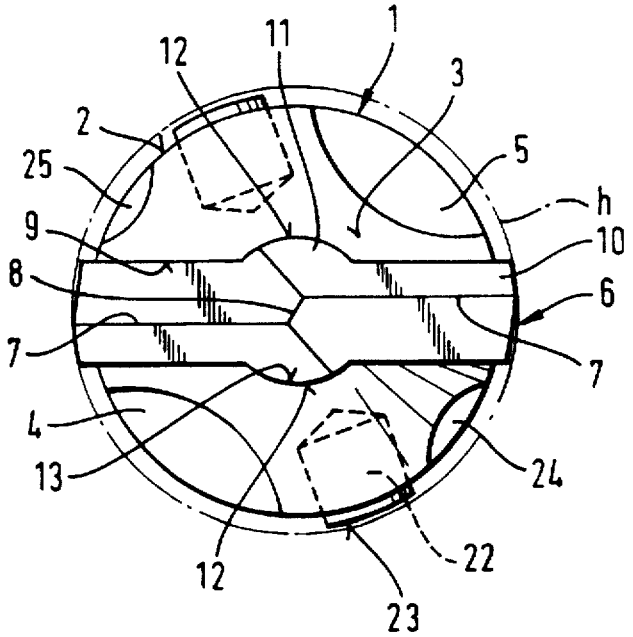
FIG. 2 is plan view of the drill illustrated in FIG. 1.

In FIGS. 1 and 2, one embodiment of the percussive blow assisted rotary drill embodying the present invention is illustrated comprising an axially extending shank 1, only the leading end region of the shank is illustrated. The shank has an axially extending outside surface 2 containing two main drilled material removal grooves 4, 5 with the grooves extending helically along the outside surface towards a trailing or chuck end. A cutting plate 6 with hard metal cutting edges 7 is seated in a leading end face 3 of the shank 1. The cutting plate 6 is fixed in a groove 9 extending across a diameter of the shank 1. The groove extends axially inwardly from the leading end face 3. A central region 11 of a base portion 10 of cutting plate 6 has a thickened or reinforcing region projecting outwardly from the sides of the cutting plate in the form of a partly circular projection 12. As shown, the cutting plate 6 has a projection 12 on both sides of the base portion 10 with the projections being located symmetrically opposite one another. The continuous groove 9 in the leading end face 3 of the shank 1 is provided with correspondingly shaped recesses 13 in both of the long sides of the groove and in the central region of the shank 1. The cutting plate 6 when inserted into the groove 9 is retained with the projections 12 fitted into the corresponding shaped recesses 13 of the groove 9 preventing an radially displacement by a positive lock of the projections 12 in the recesses 13. The cutting plate 6 is fixed in the axial direction in a known manner, for instance by soldering, into the groove 9. The maximum cross section of the base part 10 in the region of the outwardly extending projections is in the range of approximately 1.2 to 2 times the thickness of the cutting plate 6 and preferably about 1.5 times such thickness.

While the embodiment illustrated in FIGS. 1 and 2 has symmetrically arranged projections 12 on the opposite sides of the central region of the base part 10, it will be appreciated that the projections on the long sides of the cutting plate 6 can also be arranged offset relative to one another. Further, it is also possible to provide only a single partly circularly shaped projection on one side of the cutting plate 6. The continuous groove 9 formed in the leading end face 3 of the shank 11 and extending across its diameter is provided with one or several recesses 13 to correspond to the arrangement of the projections 12.

Figure 3:
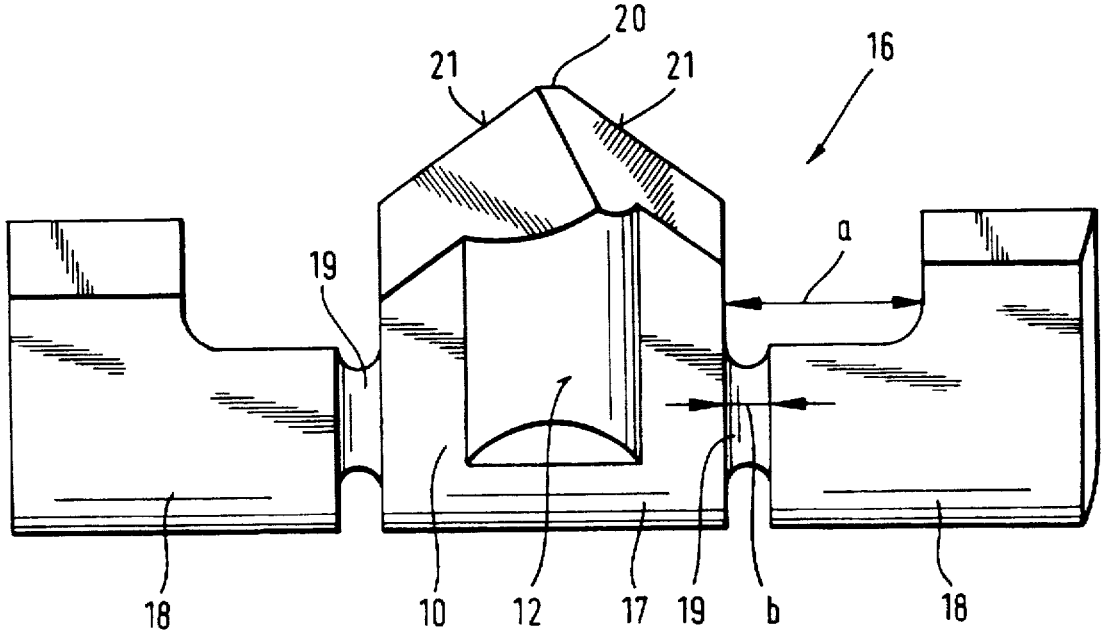
FIG. 3 is another embodiment of the invention illustrating a multi-part cutting plate in side view.
Figure 4:
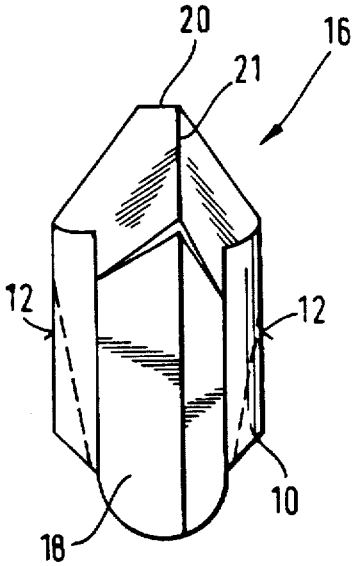
FIG. 4 is a narrow end view of the cutting plate in FIG. 3.

In FIGS. 3 and 4 another embodiment of the invention is illustrated with the cutting plate 16 having reinforcing projections 12 in the central region 11, that is, centrally located between the opposite ends of the cutting plate. The reinforcement of the base portion 10 when the cutting plate 16 is inserted in the leading end of the shank can be arranged in different ways. As shown in FIG. 4, the reinforcing projection 12 has a cylindrical shape in the axial direction. In another embodiment shown in dashed lines in FIG. 4, the reinforcing projection 12 can be basically cone shaped in the axial direction. The projection can terminate at a cone apex located opposite the tip 20 of the carbide alloy cutting edge, however, it can also be formed with the shape of a truncated cone.

In the embodiment displayed in FIGS. 1 and 2, the cutting plate 6 is continuous and has two continuous carbide alloy cutting edges 7 sloping rearwardly from a cutting edge tip 8 and also being beveled in a peaked roof-like manner, however, the cutting plate 16 in FIGS. 3 and 4 is in an interconnected multi-part unitary form. In particular, cutting plate 16 has a central cutting edge part 17 and two outwardly located parts 18 connected to the central part by thin connecting webs 19. The thickness of the connecting webs 19 is less than the thickness of the central part 17 and of the outwardly located parts 18.

The central cutting part is shaped similar to the hard metal cutting edge 7 on the continuous cutting plate 6 shown in FIGS. 1 and 2. In particular, the tip 20 of the cutting edge on the central part projects upwardly from the reinforcing projections 12 located on both sides of the cutting plate 16. Two peaked roof-like hard metal cutting edges 21 extend away from opposite sides of the tip 20 and slope downwardly toward the connecting webs 19. The cutting tip 20 of the cutting edge of the central part 17 projects axially beyond the outwardly located parts 18. Note in FIG. 3 the cutting edges of the outwardly located parts 18 have a spacing a from the cutting edges on the central part 17 and the spacing a is larger than the dimension b of the connecting webs 19 extending between the central part and the outwardly located parts. It has been found to be expedient, if the spacing a is greater than the thickness of the cutting plate 16 in the region outside the reinforcing projection 12 and smaller than half the envelope circle diameter h of the cutting edge on the central part 17. The length of the cutting edge of the central part 17 is at least equal to and preferably larger than the largest cross sectional diameter of the projection 12 on the base portion 10.

Figure 5:
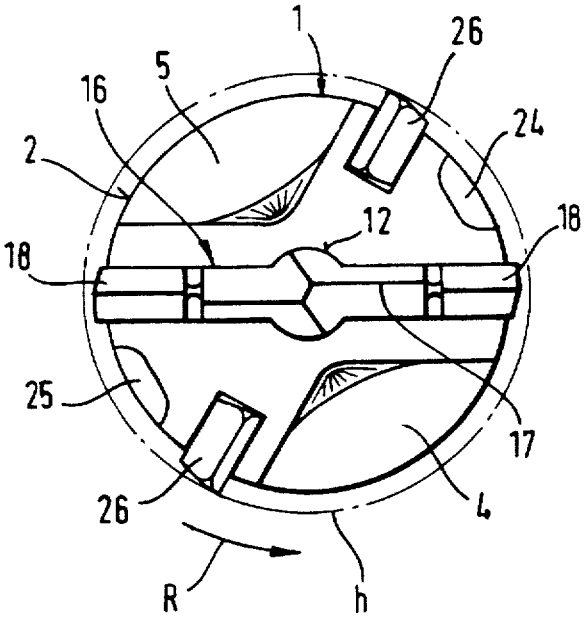
FIG. 5 is a plan view of still another embodiment of the drill of the present invention.

On the leading end face 3 of the shank 1, guide elements are provided in addition to the hard metal cutting edges 7, 21 as shown in FIGS. 1 and 2, as well as in the embodiment displayed in FIG. 5, where a multi-part cutting plate 16 is illustrated. In the embodiment of FIGS. 1 and 2 the guide elements are shaped as guide pins 22 projecting radially outwardly from the outside surface 2 of the shank 1 and fixed therein. As shown, the outward projection of the guide pins 22 from the outside surface 2 of the shank 1 is less than the outward projection of the cutting plate 6 from the outside surface 2. The envelope circle of the cutting plate 6 is indicated in dot-dash lines h. The shape of the guide surfaces 23 of the guide pins 22 spaced outwardly from the outside surface 2 of the shank 1 is matched to the contour of the outside surface. While in the showing in FIGS. 1 and 2 the guide pins protrude outwardly from the outside surface 2 of the shank 1, it is also possible to embed them in the leading end face 3 of the shank so that they project beyond the shank both radially and axially by providing a suitable inclination to the pins 22. It is also possible to embed the guide pins 22 in the circumferential region of the shank 1 so that a portion of the outside surface of the guidepins 22 project beyond the outside surface 2 of the shank 1. Instead of guide pins 22 with circularly shaped cross sections, it is also possible to provide such pins with a polygonal cross section. The guide elements can also have a plate-like shape with auxiliary cutting edges.

In the embodiment of FIG. 5, a multi-part cutting plate 16 with reinforcing projections 12 in its base portion 10 is inserted into a groove 9 where the projections are symmetrically arranged. The cutting plate 16 is similar to the one that is shown in FIGS. 3 and 4. In addition to the multi-part cutting plate 16, plate-like auxiliary cutting parts 26 are provided in the leading end face 3 of the shank 1. The additional cutting parts 26 project radially outwardly beyond the end edges of the outwardly located parts 18 and define the envelope circle h shown in dot-dash lines.

As a result, the outwardly located parts 18 merely provide a guidance function with the cutting function being afforded by the auxiliary cutting parts 26. Since the material removal function is performed by the additional cutting parts 26, the main drilled material removal grooves 4, 5 are located upstream in the rotational direction R from the additional cutting parts 26.

To dimension the main removal grooves 4, 5 for conveying the largest amount of drilled materials from the leading end face 3, it has been found to be advantageous to displace the auxiliary cutting edges 26 towards the outwardly located parts 18 of the cutting plate 16. Accordingly, the edges of the auxiliary cutting part form an acute angle with the cutting plate 16. As shown in FIG. 5, the additional cutting parts 26, can be located opposite one another on a single diameter, however, it is also possible to arrange them in a different manner. It is also possible to use a single additional cutting part instead of a pair of such cutting parts 26 and to assign a main removal groove to it. The outwardly located parts 18 provide a mere guidance function in the embodiment shown. To better convey the drilled material away from the leading end face it is possible to provide auxiliary drilled material removal grooves 24, 25 between the additional cutting parts 26 and the adjacent outwardly locating parts 18. The auxiliary removal grooves 24, 25 discharge into the main removal grooves 4, 5 along the axial length of the shank 1, though not shown. In embodiments where the additional cutting parts 26 are involved in the material removal function proper, it is advantageous to fabricate the cutting plates 6, 16 from an impact resistant material. The additional cutting parts 26 are formed from a harder and abrasive material than the cutting plates 6, 16.

Due to the outward projections reinforcing the central region of the base part of the cutting plates exactly in the central region of the drill, which is particularly highly loaded by axial blows, the drill is strengthened. Even if reinforcing steel is impacted by the drill, the danger of a failure of the drill in the region bordering the cutting plates or of the cutting plate itself is clearly reduced by reinforcing the central region. The reinforced cutting plates can better absorb the energy of the axial blows, particularly when a receiving material is being spot drilled. The drill is not prematurely blunted and has an effective useful life. The cutting plate is centered in a positively locked manner by the partly circularly shaped projections in the central region of the base portion of the cutting plate and by the correspondingly shaped recesses in the central region of the continuous groove extending across a diameter of the shank. Such an arrangement of the projections and recesses clearly facilitates the insertion of the cutting plate into the continuous groove. With a positive lock of the central region of the cutting plate in the continuous groove it is also assured that the cutting plate has the same outward projection at both of its ends from the ends of the groove and outwardly from the outside surface of the shank. Thus, drills with excellent concentric rotational properties can be manufactured in a simple manner. The recess corresponding in its shape to the reinforcing projection can be formed in a single work step, for example, following with formation of the continuous groove. Positively locked centering of the inserted cutting plates facilitates the subsequent attachment by soldering and the following hardening. The modifications described in the embodiments disclosed constitute advantageous refinements of the drill embodying the present invention.

While specific embodiments of the invention have been shown and described in detail to illustrate the inventive principles, it will be understood that the invention may be embodied otherwise without departing from such principles.

What is claimed is:

1. A percussive blow assisted rotary drill comprising an axially extending shank (1) having a leading end face (3) and at least one main drilled material removal groove (4, 5) extending helically from said leading end face in an axially extending outside surface (2) of said shank (1), a unitary cutting plate (6, 16) fitted in said leading end face of said shank and having at least one cutting edge (7, 21), said cutting plate having a base portion (10) fixed in a continuous groove (9) in said leading end face of said shank and extending across a diameter of said shank, said base portion having opposite ends and side surfaces extending between said opposite ends, said base portion (10) is reinforced intermediate the opposite ends thereof by an outward projection (12) in at least one said side surface thereof, said continuous groove (9) having opposite side surfaces extending across the diameter of said shank and at least one of said side surfaces in said groove having a recess (13) shaped to correspond to and to receive said projection on said cutting plate, so that the base portion (10) of said cutting plate is secured in a positively locked manner in said shank.

2. Percussive blow assisted rotary drill, as set forth in claim 1, wherein said projection (12) having a partly circular cross section transverse of the axial direction of said shank and being centered between the opposite ends of said cutting plate.

3. Percussive blow assisted rotary drill, as set forth in claims 1 or 2, wherein the reinforcing outward projection (12) in said base portion (10) is shaped symmetrical to the long extent between the opposite ends of said cutting plate (6, 16) and said partly circular recess (13) in said groove (9) extends axially inwardly from said leading end face (3) into said shank (1).

4. A percussive blow assisted rotary drill, as set forth in claim 3, wherein said base portion (10) of said cutting plate (6, 16) has a pair of oppositely arranged said outward projections (12) on each of the opposite side surfaces thereof and symmetrically arranged relative to the axis of said shank, and said groove (9) has corresponding said recesses (13) arranged to receive said outward projections (12) with said recesses (13) centered relative to the axis of said shank.

5. A percussive blow assisted rotary drill, as set forth in claim 1 or 2, wherein said outward projection (12) forms a portion of a cylinder in the axial direction of said shank (1).

6. A percussive blow assisted rotary drill, as set forth in claim 5, wherein said outward projection (12) has a maximum cross section in the range of 1.2 to 2 times a thickness of said cutting plate (6, 16) extending between said side surfaces thereof.

7. A percussive blow assisted rotary drill, as set forth in claim 6, wherein the maximum cross-section of said outward projection (12) is about 1.5 times the thickness of said cutting plate extending between said side surfaces thereof.

8. A percussive blow assisted rotary drill, as set forth in claim 1 or 2, wherein said outward projection (12) forms at least a portion of a conically shaped member in the axial direction of said shank (1) with the cone-shaped outward projection tapering inwardly away from the leading end face (3) and having an apex embedded in said shank.

9. A percussive blow assisted rotary drill, as set forth in claim 8, wherein auxiliary cutting parts (26) are embedded into said leading end (3) of said shank and project outwardly beyond said outside surface (2) of said shank, said outwardly located parts (18) connected with said central part by said connecting webs (19) being located axially rearwardly of said auxiliary cutting edges (26) and being set radially inwardly of said auxiliary cutting edges (26), said outwardly locating parts each having an radially outer end serving as a guide element, and said main removal groove located in a rotational direction of said shank upstream from said auxiliary cutting edge.

10. A percussive blow assisted rotary drill, as set forth in claim 9, wherein said cutting plate (6, 16) is formed of in impact resistant material and said auxiliary cutting edges (26) are formed of a harder material than said cutting plates (6, 16).

11. A percussive blow assisted rotary drill, as set forth in claims 1 or 2, wherein said cutting plate (16) is divided into a central part having a central cutting edge and two outwardly located parts (18) extending outwardly from on opposite ends of said central part, said central part connected to said outwardly located parts each by a thin connecting web (19) and said web having a width extending in the direction between the opposite end surfaces of said cutting plate smaller than the width of said central part and said outwardly located parts, said central cutting edge on said central part projecting axially outwardly from said outward projection and beyond said outwardly located parts, and said outwardly located parts (18) each having a leading edge thereof spaced laterally outwardly from said central cutting edge of said central part greater than a dimension b of said connecting webs (19) in the direction extending between said central part and said outwardly located parts.

12. A percussive blow assisted rotary drill, as set forth in claim 11, wherein said spacing of said leading end edges of said outwardly located parts being greater than the width of said cutting plate and less than half an envelope circle diameter of said central cutting edge on said central part.

13. A percussive blow assisted rotary drill, as set forth in claim 11, wherein said central cutting edge of said central part being at least equal to a largest cross-sectional diameter of said radially outward projection (12).

14. A percussive blow assisted rotary drill, as set forth in claim 13, wherein said central cutting edge of said central part having an extent in the direction extending between the opposite ends of said cutting plate greater than the largest cross-sectional diameter of said outward projection (12).

15. A percussive blow assisted rotary drill, as set forth in claim 1 or 2, wherein said leading end face (3) of said shank (1) having hard metal cutting edges (7, 21) and having guide elements (22) fixed in one of the leading end face (3) and the outside surface (2) of the shank and projecting outwardly beyond the outside surface (2) of the shank with the outward projection of said guide elements being equal to the outward projection of said cutting plates (6, 16) from said outside surface (2), and said guide elements having a shape in the circumferential direction of said shank matching the shape of said outside surface (2) of said shank (1) in the circumferential direction.

16. A percussive blow assisted rotary drill, as set forth in claim 15, wherein the outward projection of said guide elements is less than the outward projection of said cutting plates at the opposite ends thereof.

* * * * *